US007028359B2

(12) United States Patent
Mazur

(10) Patent No.: US 7,028,359 B2
(45) Date of Patent: Apr. 18, 2006

(54) CONTAINER OPENER

(76) Inventor: Robert Mazur, 9378 Baywood Rd., Plymouth, MI (US) 48170

( * ) Notice: Subject to any disclaimer, the term of this patent is extended or adjusted under 35 U.S.C. 154(b) by 0 days.

(21) Appl. No.: 10/728,579

(22) Filed: Dec. 5, 2003

(65) Prior Publication Data

US 2004/0111803 A1 Jun. 17, 2004

Related U.S. Application Data

(63) Continuation of application No. 10/365,811, filed on Feb. 13, 2003, now abandoned.

(60) Provisional application No. 60/356,595, filed on Feb. 14, 2002, provisional application No. 60/412,645, filed on Sep. 23, 2002.

(51) Int. Cl.
*B67B 7/00* (2006.01)

(52) U.S. Cl. ..... 7/156; 81/3.09; 81/3.55; 81/3.47; 81/3.48

(58) Field of Classification Search ..... 81/3.09, 81/3.08, 3.55, 3.47, 3.57, 3.48, 3.49; 7/151, 7/152, 156, 169, 170, 158
See application file for complete search history.

(56) References Cited

U.S. PATENT DOCUMENTS

| | | | | |
|---|---|---|---|---|
| 899,408 | A * | 9/1908 | Taylor et al. | 30/408 |
| D43,268 | S | 11/1912 | Cary | |
| D79,877 | S | 11/1929 | Avillar | |
| D87,644 | S | 8/1932 | Kurt | |
| 2,151,209 | A | 3/1939 | Hohmann | |
| D117,768 | S | 11/1939 | Casebeer | |
| D123,405 | S | 11/1940 | Labich | |
| 2,230,376 | A | 2/1941 | Cullen | |
| 2,386,416 | A | 10/1945 | Wilhelm | |
| D154,880 | S | 8/1949 | Ross | |
| D159,714 | S | 8/1950 | Brackin | |
| D161,321 | S | 12/1950 | Fee | |
| 2,655,259 | A | 10/1953 | Davoren | |
| 3,650,445 | A | 3/1972 | Heitzman | |
| 3,751,743 | A | 8/1973 | Buck | |
| 3,815,802 | A | 6/1974 | Stevens | |
| 3,885,478 | A | 5/1975 | Evans | |
| 4,073,205 | A | 2/1978 | Silliman | |
| 4,159,568 | A | 7/1979 | Berner | |
| 4,178,646 | A | 12/1979 | Swartz et al. | |
| 4,179,806 | A | 12/1979 | Lieptz | |
| 4,422,553 | A | 12/1983 | Hoeks et al. | |
| 4,455,894 | A | 6/1984 | Roberts | |
| 4,549,451 | A * | 10/1985 | Widman | 81/3.47 |
| 4,770,069 | A | 9/1988 | Mikan et al. | |
| 4,835,860 | A | 6/1989 | Infeld | |
| 4,918,775 | A | 4/1990 | Leu | |
| D310,731 | S | 9/1990 | Lieptz | |
| D318,210 | S | 7/1991 | Lloyd | |
| 5,118,021 | A | 6/1992 | Fiocchi | |
| 5,197,194 | A * | 3/1993 | Sorensen et al. | 30/260 |

(Continued)

*Primary Examiner*—Debra S. Meislin
(74) *Attorney, Agent, or Firm*—Loletta L. Darden

(57) ABSTRACT

A multifunctional container opener for opening a plurality of different containers, including a body that supports a template defining one or more pockets and a pill splitting tool and one or more compartments or pockets for capturing pieces of the split pill or tablet. The body may also support a variety of tools adapted for opening a container or accessing a container's contents. Such tools include tools for piercing, scoring, cutting or prying portions of the actual container or safety seals associated with the container. The body also supports a gripping device for frictionally engaging the cap or top of a container.

1 Claim, 5 Drawing Sheets

U.S. PATENT DOCUMENTS

| | | | | |
|---|---|---|---|---|
| 5,313,859 | A | 5/1994 | Gabry | |
| 5,322,227 | A | 6/1994 | Fiocchi | |
| 5,356,010 | A | 10/1994 | Weinstein | |
| 5,431,283 | A | 7/1995 | Weinstein | |
| 5,517,881 | A | 5/1996 | Burns | |
| 5,621,936 | A | 4/1997 | Penaligon | |
| 5,652,988 | A | 8/1997 | Appelhoff | |
| 5,735,181 | A | 4/1998 | Anderson | |
| D403,227 | S | 12/1998 | Tseng | |
| 5,863,001 | A | 1/1999 | Schulze | |
| 5,944,243 | A | 8/1999 | Weinstein | |
| 6,092,289 | A * | 7/2000 | Schad | 30/112 |
| 6,205,888 | B1 | 3/2001 | Laudani | |
| 6,212,721 | B1 | 4/2001 | Borodulin | |
| 6,263,761 | B1 | 7/2001 | Ryder | |
| D447,923 | S * | 9/2001 | Taylor et al. | D8/40 |
| 6,289,768 | B1 * | 9/2001 | Anderson et al. | 81/3.09 |
| 6,449,218 | B1 | 9/2002 | Lluch | |
| D470,370 | S | 2/2003 | Arnold | |

* cited by examiner

CONTAINER OPENER

CROSS REFERENCE

This application is a continuation of U.S. patent application Ser. No. 10/365,811, filed Feb. 13, 2003, now abandoned, which claims priority to Provisional Patent Application No. 60/356,595 filed on Feb. 14, 2002, and entitled Medicine Opener, and Provisional Patent Application No. 60/412,645 filed on Sep. 23, 2002, and entitled Container Opener.

FIELD OF THE INVENTION

The present invention relates to a multifunctional device including various tools for performing many functions required for opening a variety of containers. More particularly, the present invention relates to a multifunctional hand-held device having tools for performing the functions required for opening containers that hold consumer directed products such as, but not limited to, over-the-counter medications, pharmaceuticals or medicants, food and potable beverages.

BACKGROUND OF THE INVENTION

Often containers used to retain consumer directed products are purposefully designed to be difficult to open in order to prevent or deter tampering with the container's content. For example, cartons, such as, but not limited to, cardboard or corrugated paper food containers may be sealed using an FDA approved adhesive. Food containers may also include an inner foil pack that must be opened by breaking an adhesive or heat-sealed bond. Bottles containing beverages may include twist-off caps that require breaking a safety seal before the cap can be removed, and metal beverage containers may include a push or pull-tab of the type typically contained on soft drink cans. Medicant or pharmaceutical containers may include a safety cap that requires prying the cap off the container or the performance of several motions simultaneously, e.g., pushing down and twisting, in order to remove the cap. These containers may also include a safety seal that must be removed before the container's contents may be accessed. Further still, other forms of medicant or pharmaceutical containers may include adhesively bonded or heat-sealed foil backings bonded to a flexible plastic container. These types of containers include, but are not limited to, blister packs. While the described features, as well as and other similar features not mentioned, serve useful purposes, their presence may severely inhibit access to a container's contents.

Therefore, there is needed a device that includes tools for assisting with the performance of the functions required for manually opening containers containing consumer directed products. More specifically, there is needed a device for assisting with the performance of the functions required for opening medicine or pharmaceutical containers.

SUMMARY OF THE INVENTION

This invention relates to a multifunctional container opener for opening a plurality of different containers. The container opener may also be a hand-held device that includes a body that supports a template defining one or more pockets. The template may include a pill splitting tool and compartments or pockets for retaining pieces of the split pill or tablet.

The body may also support a variety of tools adapted for opening a container or accessing a container's contents. Such tools may include tools for piercing, scoring, or cutting portions of the actual container or safety seals associated with the container. The body may also support a gripping device that facilitates opening various types and sizes of containers that are closed by a top or cap.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

A detailed description of the present invention is described herein with reference to the accompanying drawing figures. Terms of reference such as "top," "bottom," "front," "back," or "side" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

Figure 1:
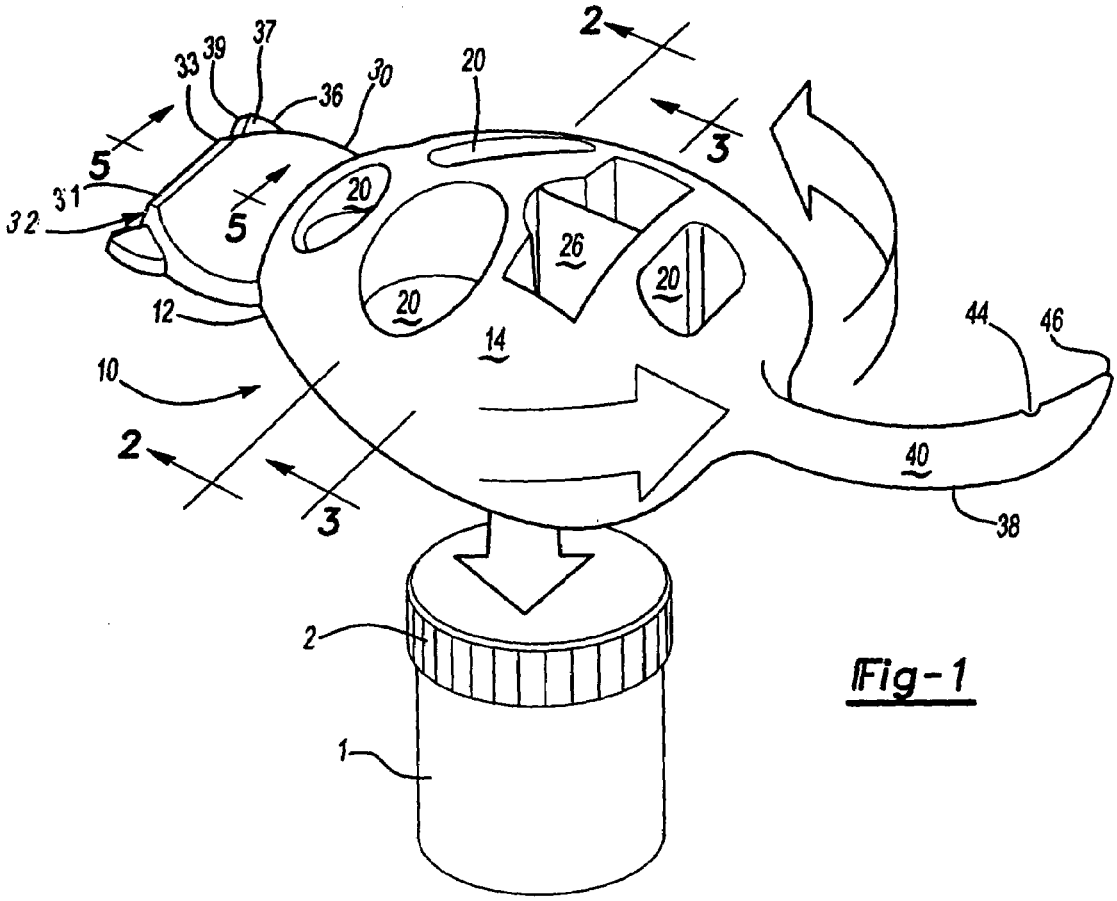
FIG. 1 is a perspective view of a container opener formed in accordance with the teachings of the present invention.

FIG. 1 shows a container opener 10 formed in accordance with the teachings of this invention. The configuration shown in FIG. 1 may be used to open or facilitate access to the contents of a variety of containers. The container opener 10 shown in FIG. 1 includes a body 12 molded as a one-piece structure. Plastic materials such as ABS, polyethylene, polypropylene, vinyl, nylon, or other materials having similar strength and durability may be used to form the body 12. It will also be appreciated by those of ordinary skill in the art that the body 12 could be molded as one or more separate elements that may be secured to or supported by the body using techniques known and used by those of ordinary skill in the art.

The container opener 10 as shown in FIG. 1 shows the body 12 molded into the form of a cat. It will be appreciated, however, by those of ordinary skill in the art that the body 12 could be formed using any variety of shapes, including but not limited to common geometric shapes, various animal shapes, numerals, letters, etc.

Figure 2:
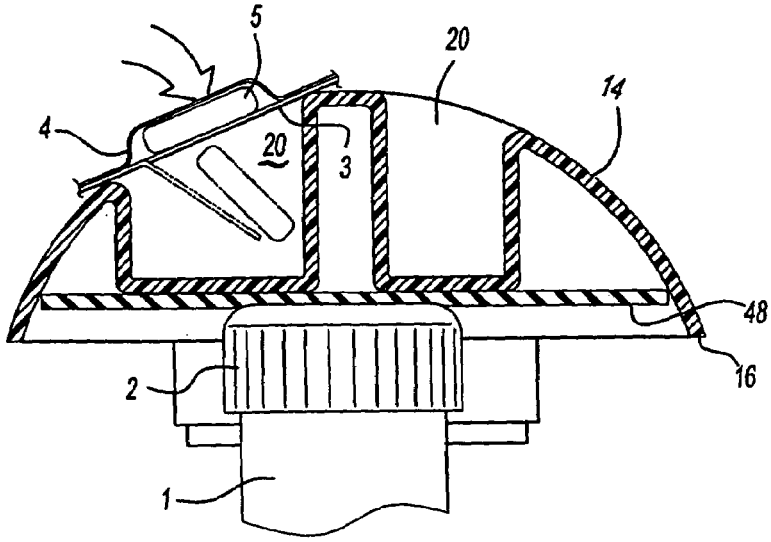
FIG. 2 is a section view showing the pockets of a template defined by the container opener shown in FIG. 1.
Figure 3:
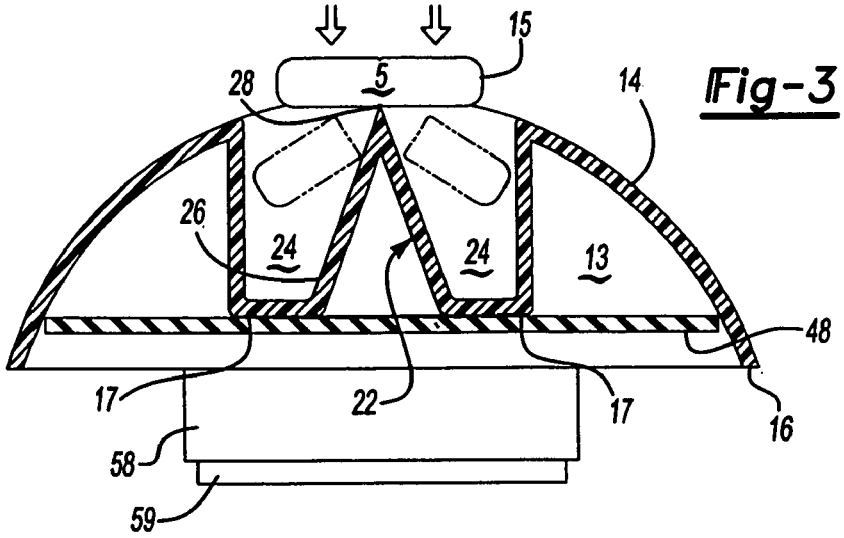
FIG. 3 is a section showing view of a pill splitter supported by the container opener shown in FIG. 1.
Figure 6:
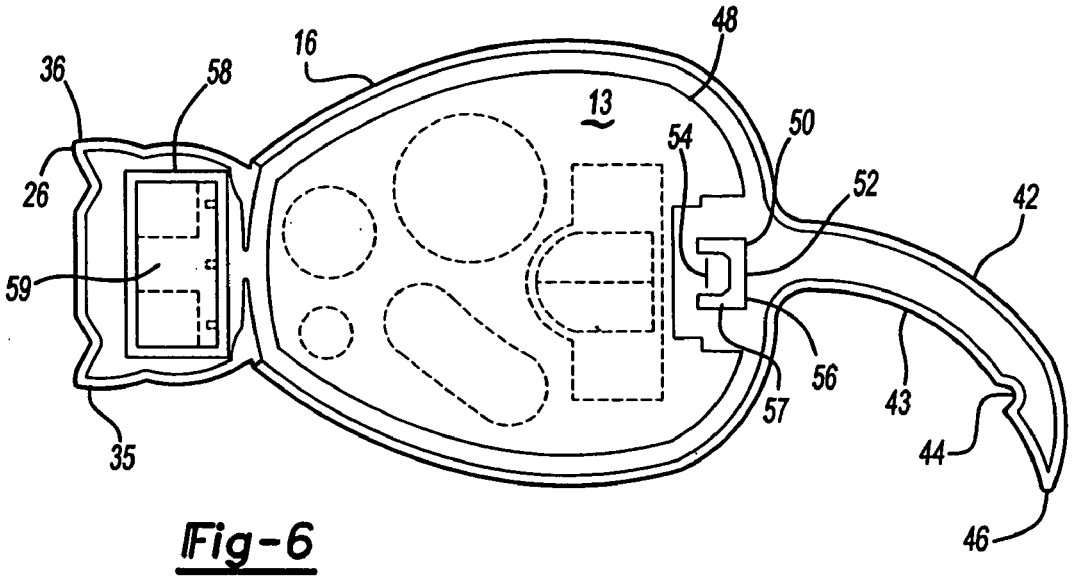
FIG. 6 is a bottom view of the container opener shown in FIG. 1.

As best seen in FIGS. 1, 2 and 3, the body 12 includes a cup-shaped center portion 14 surrounding a hollow center 13. As best seen in FIGS. 3 and 6, the cup-shaped center portion 14 also includes a flat bottom edge portion 16. The cup-shaped portion 14 may be molded to include a template 18 that defines one or more variously sized pockets 20. As best seen in FIG. 3, the pockets 20 may extend downwardly from the cup-shaped portion 14, each terminating in a closed bottom surface 17 positioned just above the bottom edge surface 16.

As shown in FIG. 2, the pockets 20 may be configured in a variety of shapes. As shown in FIG. 2, a pocket 20 may be used by placing the back portion 3 of a pill container 4 such as a blister pack over the opening of the pocket 20, ideally the foil backing of the container 4 will have been scored or pierced prior to placing the foil backing over the pocket 20. As best illustrated in FIG. 2, the application of an appropriate pressure to the front surface of the pill container 4 causes a pill 5 to fall from the pill container 4 and into the pocket 20.

Figure 4:
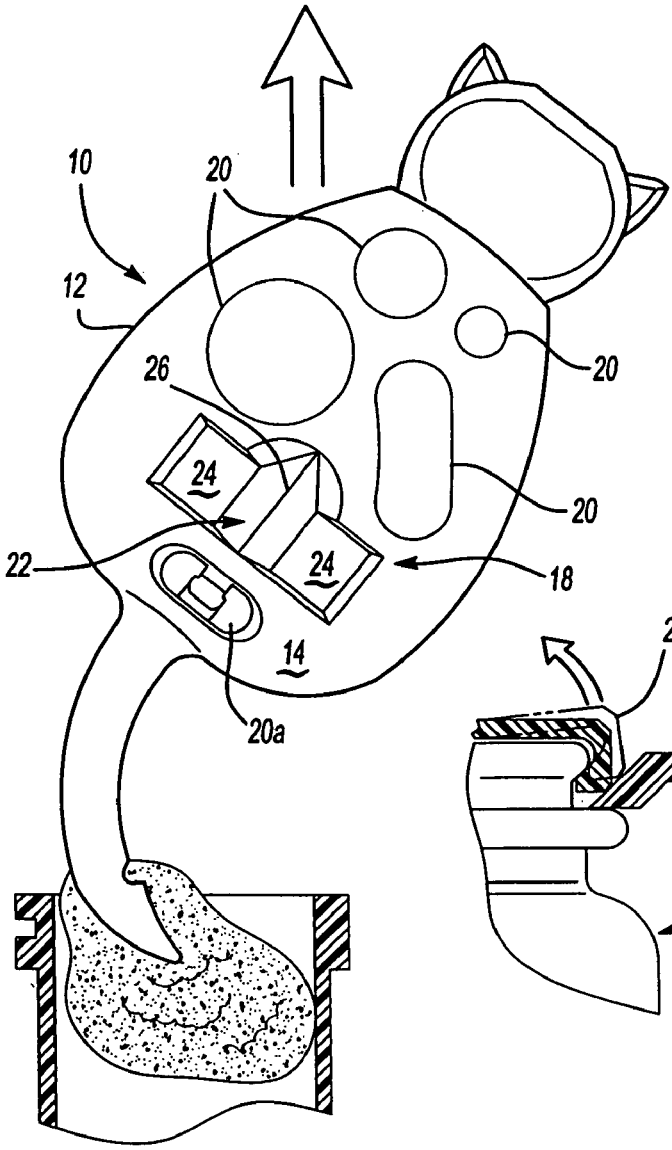
FIG. 4 is a top view showing the container opener of shown in FIG. 1 being used to remove a filler material from a container.

The template 18 may also include a pill splitter 22, as best seen in FIGS. 3 and 4. The pill splitter 22 may be integrally formed with the body 12 and may include a pocket 24 that is divided into two compartments by an upwardly extending wall 26. The wall 26 defines a pointed upper edge portion 28. As best seen in FIG. 3, when a pill 5 is pressed against the upper edge portion 28 and a downward force applied to the pill 5, the pill 5 may break into two or more pieces. Ideally, the pill 5 breaks as shown in FIG. 3 and falls into the compartments of pocket 24.

Figure 8:
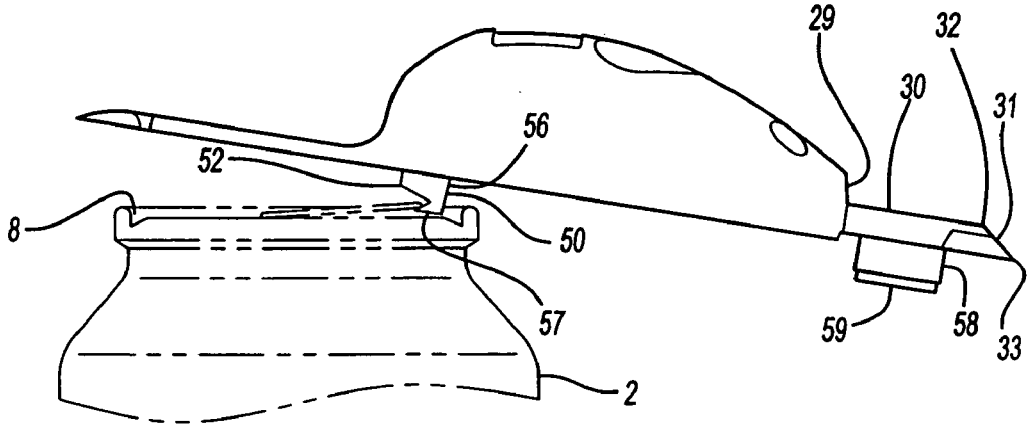
FIG. 8 is an elevation view demonstrating one use of the container opener shown in FIG. 1.

Referring now to FIG. 8, the body 12 may be molded to include a flat surface 29, which may be used as a finger rest or guide. Adjacent the flat surface 29, the body 12 may support an integrally formed outwardly extending member 30. Outwardly extending member 30 defines a prying tool 32 that may include a flat downwardly sloping surface 31 that terminates at a pointed edge 33. The pointed edge 33 is contiguous with a flat bottom surface 35, as best seen in FIG. 6.

Figure 5:
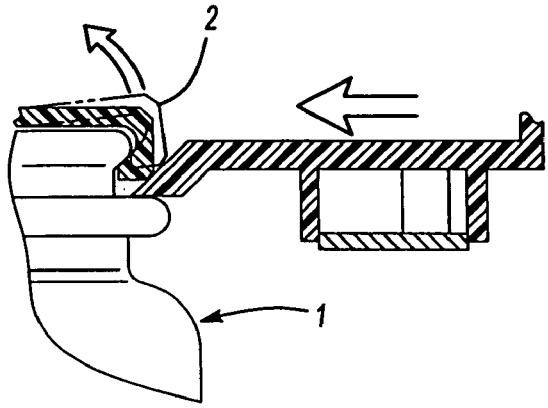
FIG. 5 is a section view illustrating one use of the container opener shown in FIG. 1.

FIG. 5 shows the prying tool 32 used to remove a cap 2 from a pill container 1. Typically, containers of the type shown in FIG. 5 are configured to permit the cap 2 to be pried off the container 1 once mating arrows (not shown) on the cap 2 and container body have been aligned. For example, once the mating arrows (not shown) have been aligned, the pointed edge 33 may be inserted between the container 1 and cap 2 as shown in FIG. 5. The downwardly sloping surface 31 may then be used to apply an upward force against the cap 2, thereby causing the cap 2 to pull away from the container body, as shown in FIG. 5.

Figure 7:
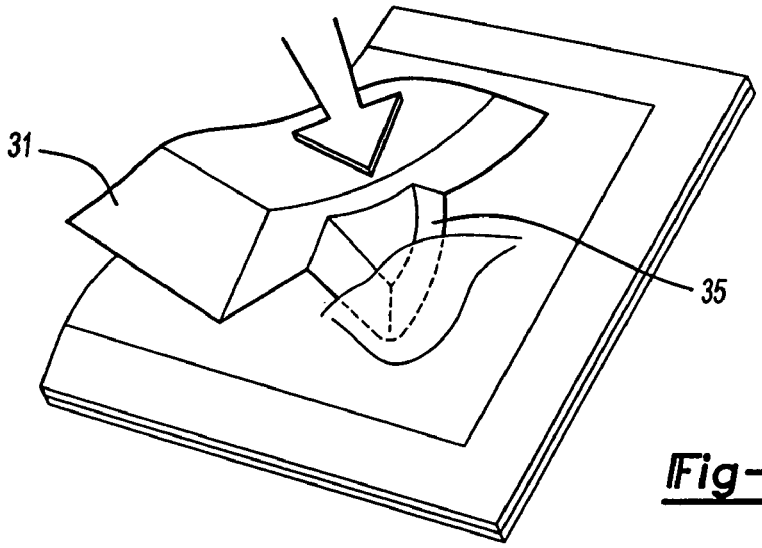
FIG. 7 is a detail view demonstrating one use of a piercing tool supported by the container opener shown in FIG. 1.

Referring now to FIGS. 1, 6 and 7, the outwardly extending member 30 may also support a piercing tool 36. The piercing tool 36 may include a flat body portion 37 that culminates in a pointed edge 39. As illustrated in FIG. 7, the pointed edge 39 may be used to score or create an opening in the backing of containers such as but not limited to blister packs, foil packs, corrugated boxes or containers or to pierce materials such as packing tape or other similar materials.

Turning again to FIG. 1, the body 12 may also support an integrally formed outwardly extending, elongated member 38. As best seen in FIGS. 1 and 6, the elongated member 38 may include top and bottom surfaces 40, 42. The elongated member 38 may also define a notch 44 a sidewall surface 43 positioned between the top and bottom surfaces 40, 42. The elongated member may also include a distal end that forms a rounded pointed edge 46.

As best seen in FIG. 4, the elongated member 38 may be used to remove a filler material such as cotton from a medicine container 1. For example, the elongated member 38 is inserted into the container and the pointed edge 46 or the notch 44 may be used to grab the filler material. FIG. 4 illustrates using the notch 44 to grab a portion of the filler material.

Referring now to FIGS. 2, 3 and 6, an elastomeric pad 48 may be supported within the hollow center 13 defined by body 12. In one embodiment, the elastomeric pad 48 may be rubber or another material having similar properties. As shown in FIG. 3, the elastomeric pad 48 is positioned in the hollow center 13 so as to fit flush against the bottom surface of the pockets 20. The elastomeric pad 48 may be secured in position by an adhesive applied to either the elastomeric pad 48, the bottom portion of the mating pocket 20 surfaces or both. It will be appreciated that other techniques known and used in the industry may be used to secure the elastomeric pad 48 to the body 12. For example, the elastomeric pad could be integrally molded with the body 12.

Referring now to FIGS. 1 and 2, the elastomeric pad 48 may be used to facilitate removal of a cap 2 from a container 1. As shown in FIGS. 1–2, the opener 10 is brought into contact with a container 1 such that the top of the container cap 2 rests against the elastomeric pad 48. When pressed against the cap 2, as shown in FIG. 2, the elastomeric pad 48 remains wholly or substantially flat. As the opener 10 is twisted, as shown in FIG. 1, the cap 2 begins to turn. In some instances, both a downward and twisting motion must be applied to the cap 2 in order to remove the cap 2 from the container 1.

Referring now to FIGS. 6 and 8, a second prying tool 50 may be supported within the hollow center 13. The second prying tool 50 may be molded as part of the template 18. For example, as best seen in FIGS. 4, 6 and 8, a pocket **20*a* defined by the template 18 may be molded so as to extend though the hollow center 13, forming a rectangularly shaped body portion 52. The rectangularly shaped body portion 52 includes a partially open top surface 54. The rectangularly shaped body portion 52 may also include an endwall portion 56 that includes a tab 57 that extends outwardly from the endwall portion 56 so as to partially cover the open top surface 54**.

As best seen in FIG. 8, the second prying tool 50 may be used, for example, to remove a safety seal from the opening of a container 1. For example, the tab 57 may be used, for example, to lift one edge of the safety seal 8 from the container 1 or to lift the pull-tab of the type used on metal beverage containers.

Referring back to FIGS. 6 and 8, the container opener 10 may also support an integrally formed raised pocket 58. A magnet 59 may be received within and retained by the raised pocket 58. The magnet 59 may be secured within the raised pocket 58 using an adhesive. For example, one method of securing the magnet 59 in place includes applying a double-sided adhesive backing a (not shown). One surface of the magnet may be secured to metal flanges (not shown) that are molded into the interior of the raised pocket 58, and the other side of the magnet may be exposed as best seen in FIG. 8.

The magnet 59 may be used, for example, to secure the container opener 10 to metallic surfaces or to assist with the opening of metal containers or for lifting metal objects. For instance, the magnet may be used to lift the lid portion of a metal container out of the container's central cavity once the lid has been cut away from the container using a conventional can opener.

Another configuration of a container opener 100 formed in accordance with the teachings of this invention is shown in FIGS. 9–13. It will be appreciated by one of ordinary skill in the art that one or more of the features shown in FIGS. 9–13 could also be incorporated into container opener 10. However, for purposes of clarity and to keep the drawings simple and easy to read, the features of container opener 100 are illustrated by reference to FIGS. 9–13.

Figure 9:
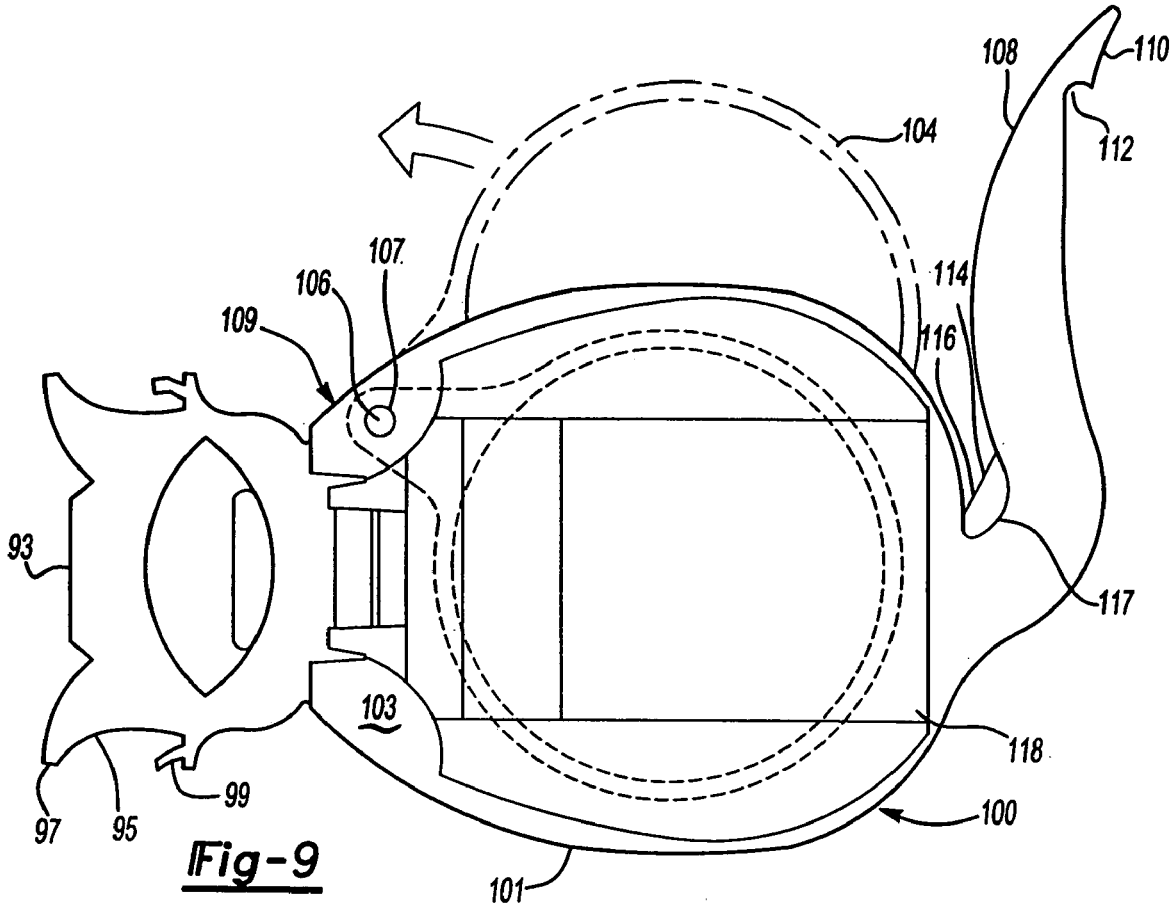
FIG. 9 is top view of illustrating additional features that may be supported by the container opener shown in FIG. 1.
Figure 13:
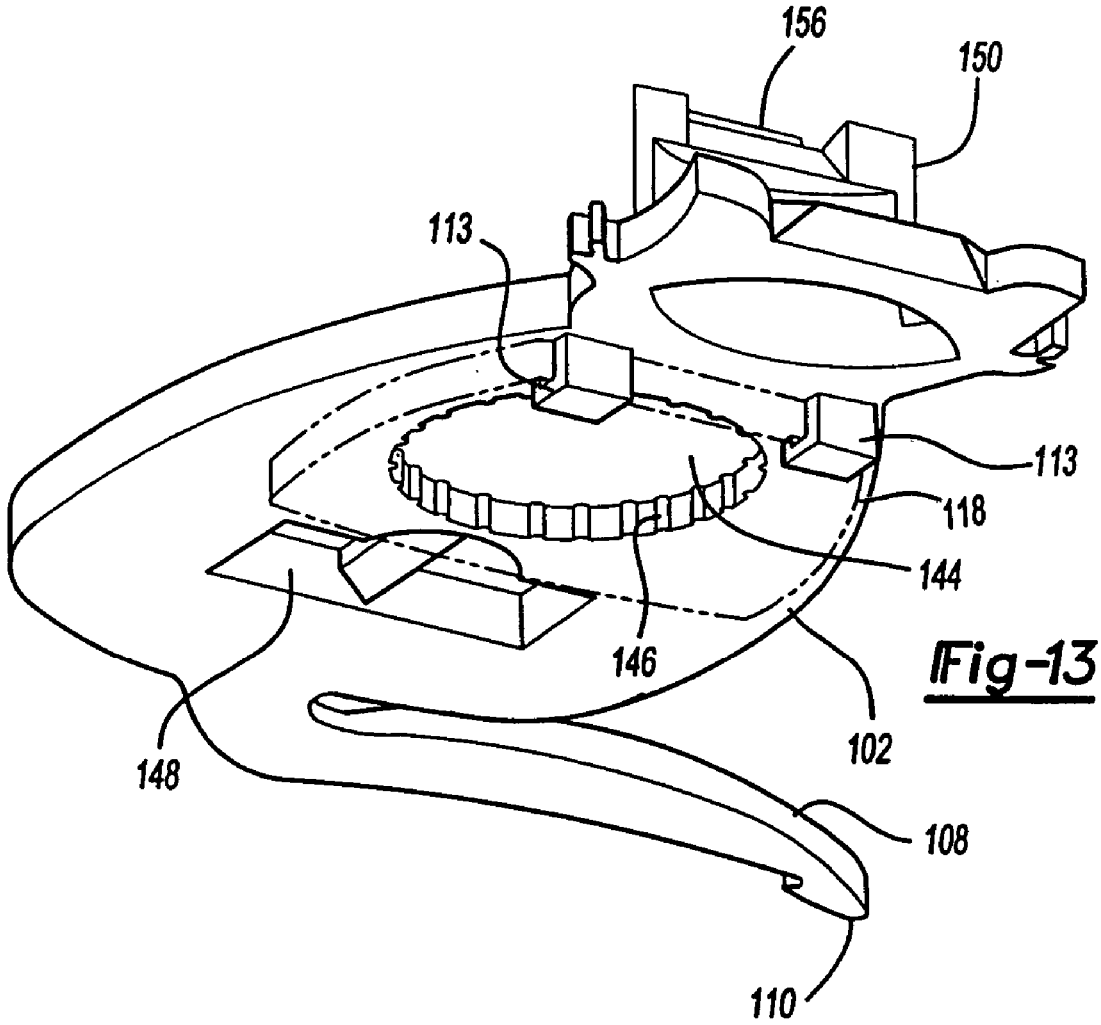
FIG. 13 is a bottom view of the container opener shown in FIG. 9.

Referring now to FIGS. 9 and 13, container opener 100 is virtually identical to container opener 10 with regard to construction and use. The container opener 100 is molded as a one-piece structure. As best seen in FIG. 9, the body 101 supports an outwardly projecting member 93 that includes an arcuate shaped surface 95. At one end, the arcuate shaped 95 surface terminates in a blunt end 97. At the opposite end, the arcuate shaped surface 95 supports a two-pronged member 99. The combination of elements 95, 97 and 99 defines a tool that may be used, for example, to remove metal bottle tops from glass. For example, a bottle cap may be removed by placing the arcuate surface 95 against the top surface of the bottle cap such that the top prong of the 2-prong member 99 is positioned along the bottom edge of the bottle cap. By rotating the container opener 100 in an upward manner, the top prong of the 2-prong member 99 forces the bottle cap out of position.

Referring back to FIGS. 9 and 13, the body 101 is shown as including a top surface 103 and a bottom surface 102. The top surface 103 of the container opener 100 may support a magnifying glass 104. As best seen in FIG. 9, the magnifying glass 104 may be coupled to the body 101 by placing an opening 106 defined by the housing supporting the magnifying glass over an outwardly extending post 107 integrally formed with the body 101.

The body 101 also supports an elongated member 108. The elongated member 108 is virtually similar to the elongated member 38 previously described. However, elongated member 108 may include an elongated flat end 110 that intersects an arcuate notch 112. This construction may permit the elongated member to be used to open containers or to pierce packages.

The elongated member 108 may also support a cutting tool 114. As shown in FIG. 8, the cutting tool may be positioned in a U-shaped area 117 formed by the elongated member 108. The cutting tool 114 may be formed of metal, and may include an appropriately sharpened upper edge 116. The cutting tool may be a device such as a razor blade that has been molded into the elongated member 108. One use of the blade may be to open packages such as envelopes.

Figure 10:
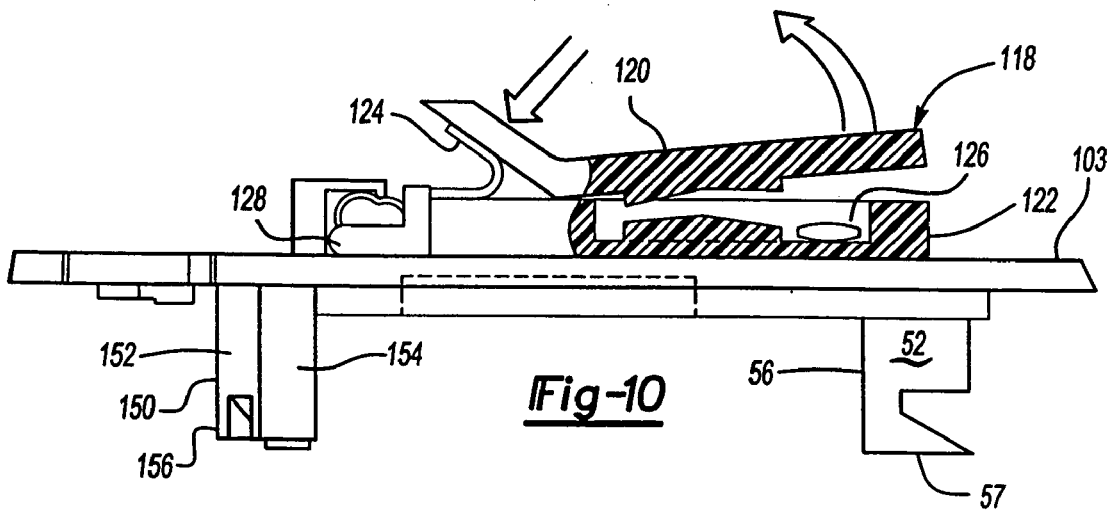
FIG. 10 is a section view showing a pill carrier that may be supported by the container opener shown in FIG. 9.

Referring now to FIG. 10, the top surface 103 of the body 101 may support a removable pill carrier 118. The removable pill carrier 118 includes a top surface 120 coupled to a bottom surface 122 by a hinge connection 124. The top and bottom surfaces 120, 122 are coupled so that the top surface 120 pivots upward when a downward pressure is applied to the hinge 124. As best seen in FIG. 10, when closed, the pill carrier 118 defines a pocket 126 between the top and bottom surfaces 120, 122.

The pill carrier 118 may be selectively removably coupled to the top surface 103 of the body 101 by a snap-fit. As best seen in FIG. 10, the pill carrier 118 may include a rear surface 128 that supports a raised arcuate member 130. The arcuate member 130 may include a small indentation 132. The small indentation 132 is designed to received a rounded pointed end of an elongated finger 134 supported by an elongated support 136 molded as part of the top surface 103 of the body 101. Alternatively, as shown in FIG. 13, the pill carrier 118 may be secured to the body 101 by snap fitting the pill carrier into opening (not shown) defined by each of the L-shaped rectangular support members 113.

Figure 11:
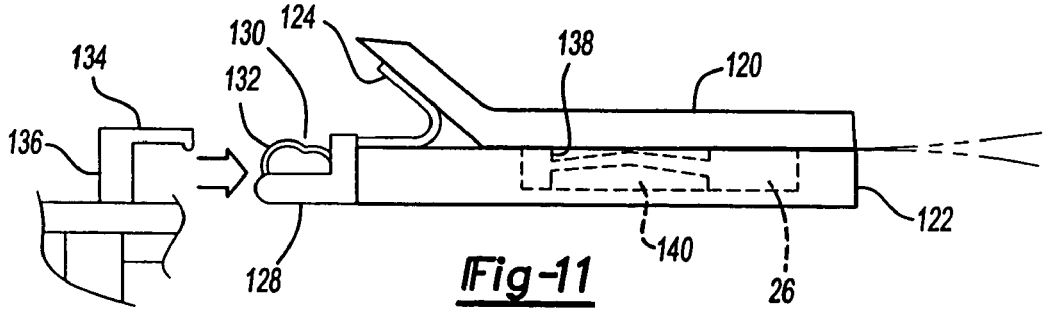
FIG. 11 is an exploded view illustrating one method for securing the pill carrier shown in FIG. 10 to the container opener shown in FIG. 9.

Alternatively, as shown in FIG. 11, the pill carrier 118 may also be used as a paper clip or similar device for supporting lightweight objects such as paper or cloth.

Figure 12:
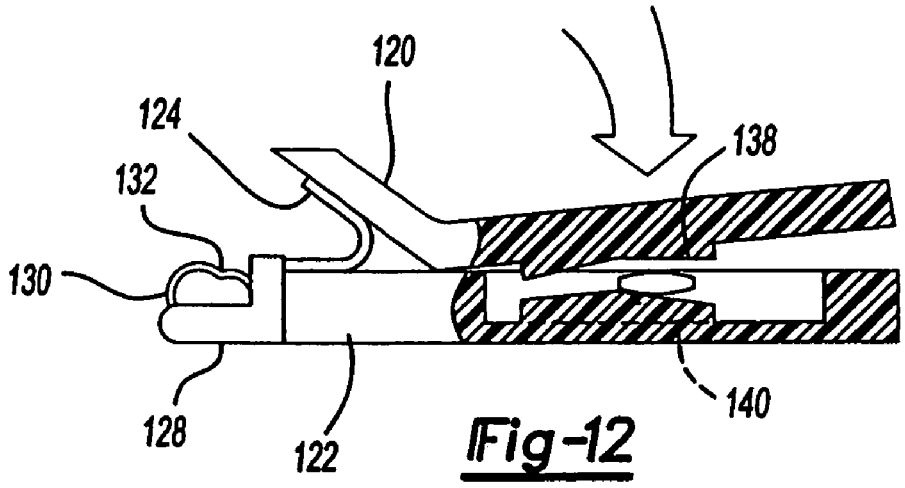
FIG. 12 is a section view illustrating a pill-crushing feature that may be included in the pill carrier shown in FIG. 10.

As best seen in FIG. 12, the pill carrier 118 may be configured to include pill-crushing surfaces 138, 140. As best seen in FIGS. 11 and 12, the pill-crushing surface 138 may include a concave shape, whereas the opposing crushing surface 140 may include a convex configuration.

FIG. 12 illustrates one method of using the pill crusher. For example, FIG. 12 illustrates placing a pill between the pill crushing surfaces 138, 140 and applying a downward force to the top surface 120, causing the pill to be crushed between surfaces 138, 140.

Referring again to FIG. 13, the bottom surface 103 of the container opener 100 may include a closed-bottom opening 144 surrounded by a serrated sidewall surface 146. One use of this particular tool may be to open containers such as, for example, jars or containers such as, for example, plastic soda bottles. FIG. 13 also shows a pill splitter 148 that is identical to the spill splitter 22 previously described.

The bottom surface 102 of container opener 100 may support an elastomeric pad (not shown) within the opening 144. The elastomeric pad may be identical to elastomeric pad 48, and may be secured to the body 101 in the manner previously described for elastomeric pad 48. Additionally, the elastomeric pad may include the template 18 and pockets 20 molded into at least a part of the elastomeric pad.

Referring now to FIGS. 10 and 13, there is shown a tool 150 that includes an arcuate body portion 152, a right side portion 154 and a left side portion 156 that defines a flat edge (not shown). The tool 150 may be used, for example, to break the vacuum seal on a vacuum-sealed jar, such as for example, a jar of jam. For instance, the tool 150 may be placed on the top of a vacuum-sealed cap such that flat edge portion of the edge 156 rests on the bottom of the cap and the top of the cap makes contact with the bottom surface 102 of the container opener 100. The vacuum seal may be broken, for example, by rocking the tool 150 such that the flat edge portion of edge 156 lifts the cap away from the sides of the sides of the jar, wherein the lifting away is just enough to release the vacuum seal.

Illustrative embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A container opener for opening a plurality of different containers, the container opener comprising:

a body;

two or more pockets defined by the body for receiving objects, wherein the two or more pockets are of different sizes;

a pill splitter defined by the body for splitting pills or tablets into two or more parts;

a piercing tool supported by the body, wherein the piercing tool is adapted for piercing and cutting; and an elastomeric pad supported by the body for frictionally engaging a cap of a container, wherein the elastomeric pad remains substantially flat when engaging the cap.

* * * * *